US006234936B1

(12) United States Patent
Wang

(10) Patent No.: US 6,234,936 B1
(45) Date of Patent: May 22, 2001

(54) TOP-PRESSING CUSHIONING MECHANISM FOR TREADMILL

(76) Inventor: Leao Wang, No 1, Lane 154, Charng Long Rd., Taiping City, Taichung Hsien (TW)

( * ) Notice: Subject to any disclaimer, the term of this patent is extended or adjusted under 35 U.S.C. 154(b) by 0 days.

(21) Appl. No.: 09/315,815

(22) Filed: May 21, 1999

Related U.S. Application Data

(63) Continuation-in-part of application No. 09/139,111, filed on Aug. 24, 1998.

(30) Foreign Application Priority Data

Jan. 12, 1999 (CN) ..... 87213079

(51) Int. Cl.[7] ..... A63B 22/00
(52) U.S. Cl. ..... 482/54

(58) Field of Search ..... 482/51, 54

(56) References Cited

U.S. PATENT DOCUMENTS 5,976,061 * 11/1999 Moon et al. ..... 482/54
5,993,358 * 11/1999 Guraghian et al. ..... 482/54

* cited by examiner

*Primary Examiner*—Glenn E. Richmon
(74) *Attorney, Agent, or Firm*—Dougherty & Troxell

(57) ABSTRACT

A top-pressing cushioning mechanism for treadmill has a strip-shaped coupled member pivoted on two sides of a frame of the treadmill, the bottom end of the coupled member is provided with a resilient cushioning element which is pressed against the face of a blocking piece of the inner side of a supporting base. Thus the shaking force on the frame can be effectively reduced by means of the resilient cushioning member and the blocking piece.

3 Claims, 3 Drawing Sheets

TOP-PRESSING CUSHIONING MECHANISM FOR TREADMILL

The present invention is a continuation-in-part of U.S. patent application Ser. No. 09/139,111, filed Aug. 24, 1998.

BACKGROUND OF THE INVENTION

The present invention relates to a top-pressing cushioning mechanism for a treadmill, and more particularly including a top-pressing coupled member shaped in a strip form to protect the coupled member from breaking when being forced.

The top-pressing coupled member disclosed in the U.S. patent application Ser. No. 09/139,111 is arch-shaped so that a downward pressure (the forced point is situated at the front end of the horizontal surface of the coupled member) and a forward top-pressing force (the forced point is situated at the bottom end of the vertical surface of the coupled member) will be created when being forced. These forces from different directions will easily cause a tremendous shear stress at the connecting position between the horizontal and the vertical surface. Therefore, it's likely that the connecting position will be deformed and even broken after using for a long period, and the expected effect won't be fulfilled any more.

SUMMARY OF THE INVENTION

It is a main object of the present invention to provide a top-pressing cushioning mechanism for a treadmill whose coupled member is shaped in a strip form and whose resilient cushioning element is placed under the coupled member. Thus, the coupled member is forced up- and downwards by means of a blocking member disposed under the resilient cushioning element so that the coupled member can be protected from deforming and breaking so as to prolong the using life and to maintain its expected effect for a long time.

BRIEF DESCRIPTION OF THE DRAWINGS

The drawings illustrate an embodiment of the present invention which serves to exemplify the various advantages and objects thereof, and are as follows.

DETAILED DESCRIPTION OF THE PREFERRED EMBODIMENT

Figure 1:
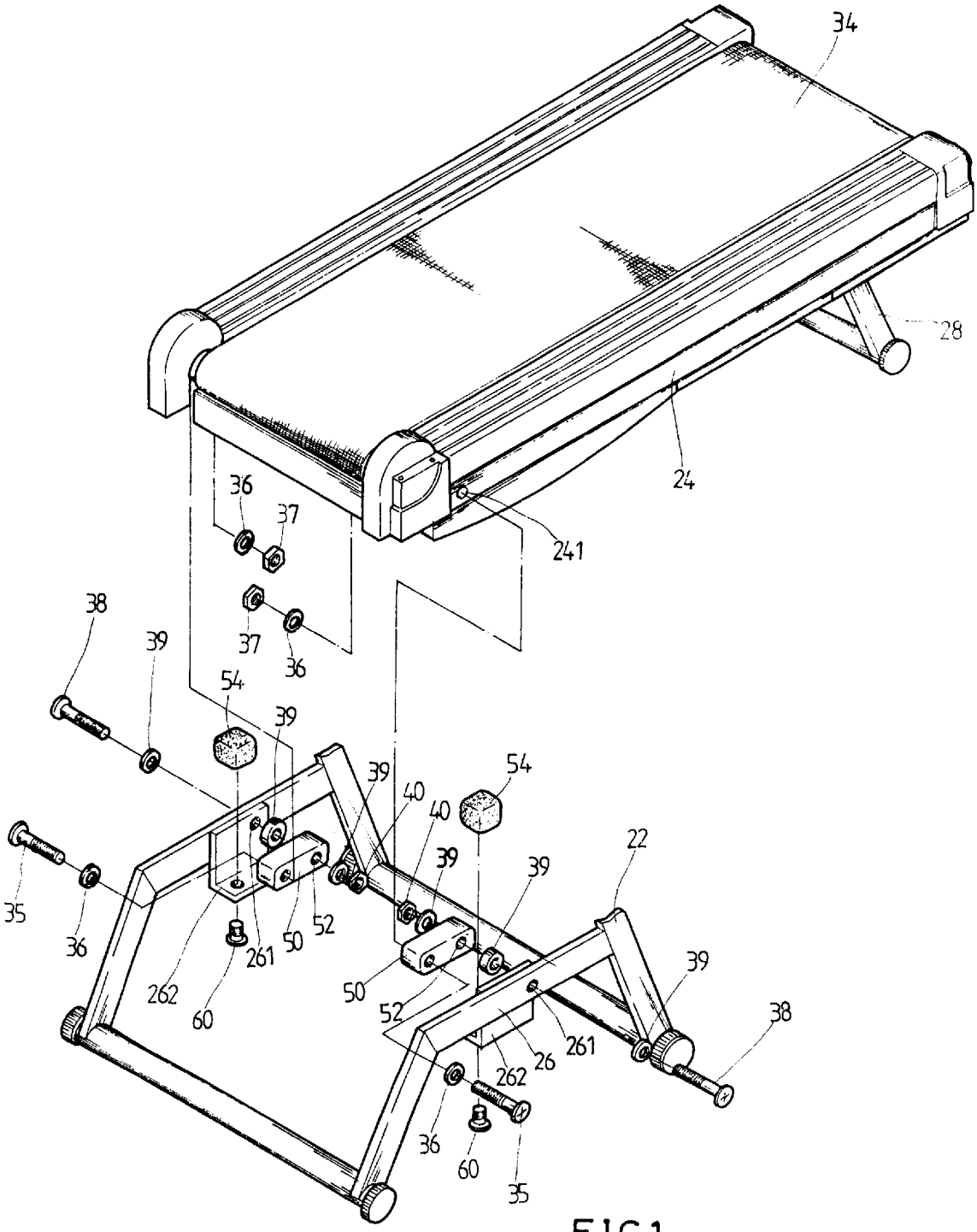
FIG. 1 is an exploded perspective view of the present invention.
Figure 2:
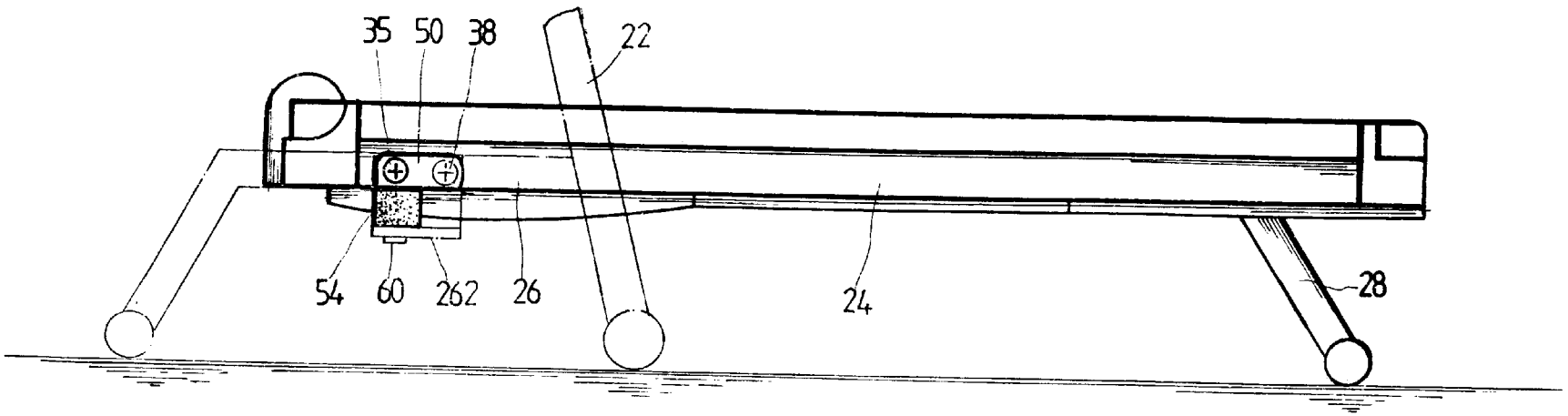
FIG. 2 is a side view of the present invention.
Figure 3:
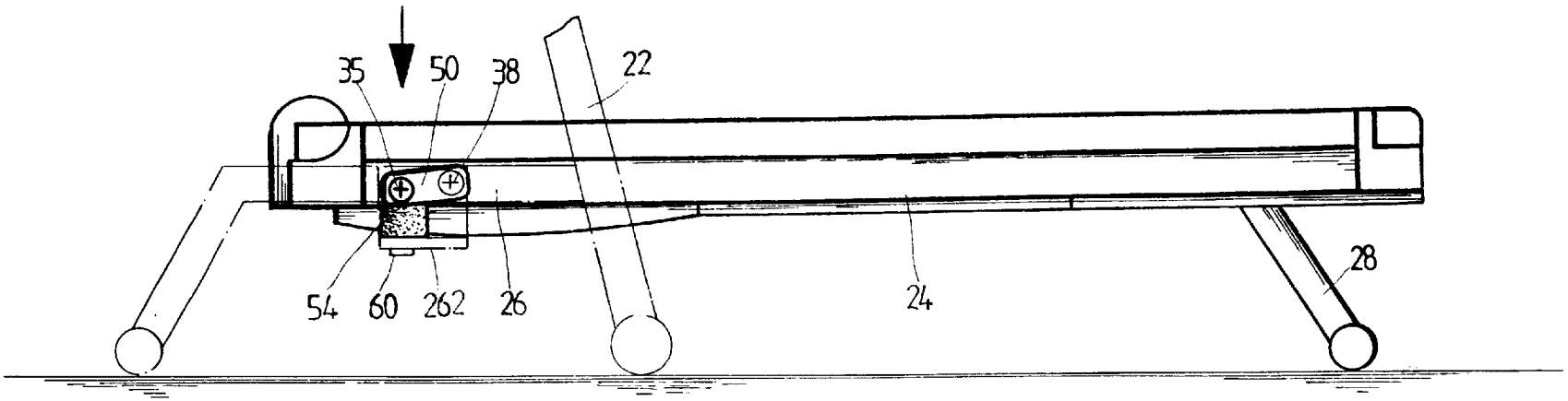
FIG. 3 is a structural application view of the present invention.

Referring to FIGS. 1 and 2, the treadmill in accordance with the present invention includes an electronic control panel (not shown), a hand support 22, a frame 24, a base 26 and a rear support 28, wherein a run plate is placed on the top face of the frame 24 and a run belt 34 is circled around the run plate in coordination with a front and rear rollers, so that the run belt 34 is able to rotate thereon. Accordingly, a user can run on the run belt 34 for jogging exercise. A pivot hole 241 is respectively disposed at a certain position on two corresponding sides of the frame 24, so that a strip-shaped coupled member 50 is pivoted thereto by means of screws 35, washers 36 and nuts 37. The coupled member 50 has a through hole 52 at the rear part thereof so as to pivot the coupled member 50 in corresponding pivot holes 261 in the base 26 by means of another set of screws 38, washers 39 and nuts 40. The bottom end of the coupled member 50 is provided with a resilient cushioning element 54 which is fixed thereto by a screw 60 and is permanently pressed against the face of an L-shaped blocking piece 262 on the inner side of the base 26. As shown in FIG. 3, the resilient cushioning element 54 after assembly is pressed against on the face of the blocking piece 262 on the base 26, so that the run plate and the frame 24 will shape when the user runs on the run belt 34 during jogging exercise. By means of the resilient cushioning element 54, the shaking phenomenon can be therefore reduced. Moreover, a closer supporting face between two sides of the run plate and the frame 24 will then be created so that deforming or breaking of the run plate can be prevented.

The coupled member 50 and the resilient cushioning element 54 can also be installed between the frame 24 and the rear support 28 with the same assembly method in order to achieve the expected effect.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A cushioning mechanism for a treadmill having a frame with a movable run belt thereon, the mechanism comprising:

a) a base for supporting the frame on a support surface, the base having two opposite side portions;

b) a pair of coupled members, each coupled member having an elongated linear configuration with first and second opposite end portions, the first end portion being pivotally attached to the frame and the second end portion being pivotally attached to one side of the base; and, c) a resilient cushioning element bearing against the first end portion of each of the coupled members and the side portion of the base, such that a force exerted on the frame will cause compression of the resilient cushioning elements, thereby reducing vibration of the treadmill during use.

2. The cushioning mechanism of claim 1 further comprising an L-shaped blocking piece attached to each opposite side portion of the base and located such that the resilient cushion element bears against a portion of the L-shaped blocking piece.

3. The cushioning mechanism of claim 1 wherein the frame has front and rear portions and wherein the coupled members are pivotally attached to the front portion of the frame.

* * * * *